United States Patent [19]

Miyashita et al.

[11] Patent Number: 4,784,588

[45] Date of Patent: Nov. 15, 1988

[54] PLUNGER PUMP

[75] Inventors: Susumu Miyashita, Sayama; Nobuyuki Hotta, Niiza, both of Japan

[73] Assignee: Kioritz Corporation, Tokyo, Japan

[21] Appl. No.: 175,676

[22] Filed: Mar. 25, 1988

Related U.S. Application Data

[63] Continuation of Ser. No. 30,259, Mar. 24, 1987, abandoned, and a continuation of Ser. No. 710,076, Mar. 11, 1985, abandoned.

[30] Foreign Application Priority Data

Mar. 14, 1984 [JP] Japan ..... 59-36292

[51] Int. Cl.[4] ..... F04B 21/04

[52] U.S. Cl. ..... 417/439; 417/542

[58] Field of Search ..... 417/439, 542, 902, 552, 417/554, 366, 372; 92/160

[56] References Cited

U.S. PATENT DOCUMENTS

| | | | |
|---|---|---|---|
| 1,526,909 | 2/1925 | Hiller | 417/439 |
| 1,531,616 | 3/1925 | Jacobson | 417/439 |
| 2,065,162 | 12/1936 | Trask | 417/902 X |
| 2,113,691 | 4/1938 | Heller | 417/902 X |
| 2,933,049 | 4/1960 | Johnston | 92/168 |
| 3,180,273 | 4/1965 | Loliger | 92/168 |
| 3,216,365 | 11/1965 | Deffinger et al. | 92/168 |
| 3,330,217 | 7/1967 | Baur et al. | 417/454 |
| 3,413,929 | 12/1968 | Cook et al. | 92/168 |
| 3,470,823 | 10/1969 | Seeger | 417/559 |
| 3,584,981 | 6/1971 | Worster | 417/542 |
| 3,887,305 | 6/1975 | Ito | 417/439 |
| 3,947,157 | 3/1976 | Sadler | 417/559 |
| 4,456,439 | 6/1984 | Wolff | 417/539 |
| 4,462,302 | 7/1984 | Hertell | 417/552 X |
| 4,561,828 | 12/1985 | Wolff | 417/539 |

FOREIGN PATENT DOCUMENTS

| | | | |
|---|---|---|---|
| 18200 | 10/1900 | United Kingdom | 417/439 |

*Primary Examiner*—Carlton R. Croyle
*Assistant Examiner*—Ted Olds
*Attorney, Agent, or Firm*—Browdy and Neimark

[57] ABSTRACT

A plunger pump including an inlet chamber for forwarding a fluid drawn by suction to a pump chamber via a suction valve, and an outlet chamber for receiving from the pump chamber a fluid pressurized in the pump chamber via a discharge valve. The inlet chamber and outlet chamber are formed in a main body and located radially outwardly of seal packings in close proximity thereto.

1 Claim, 1 Drawing Sheet

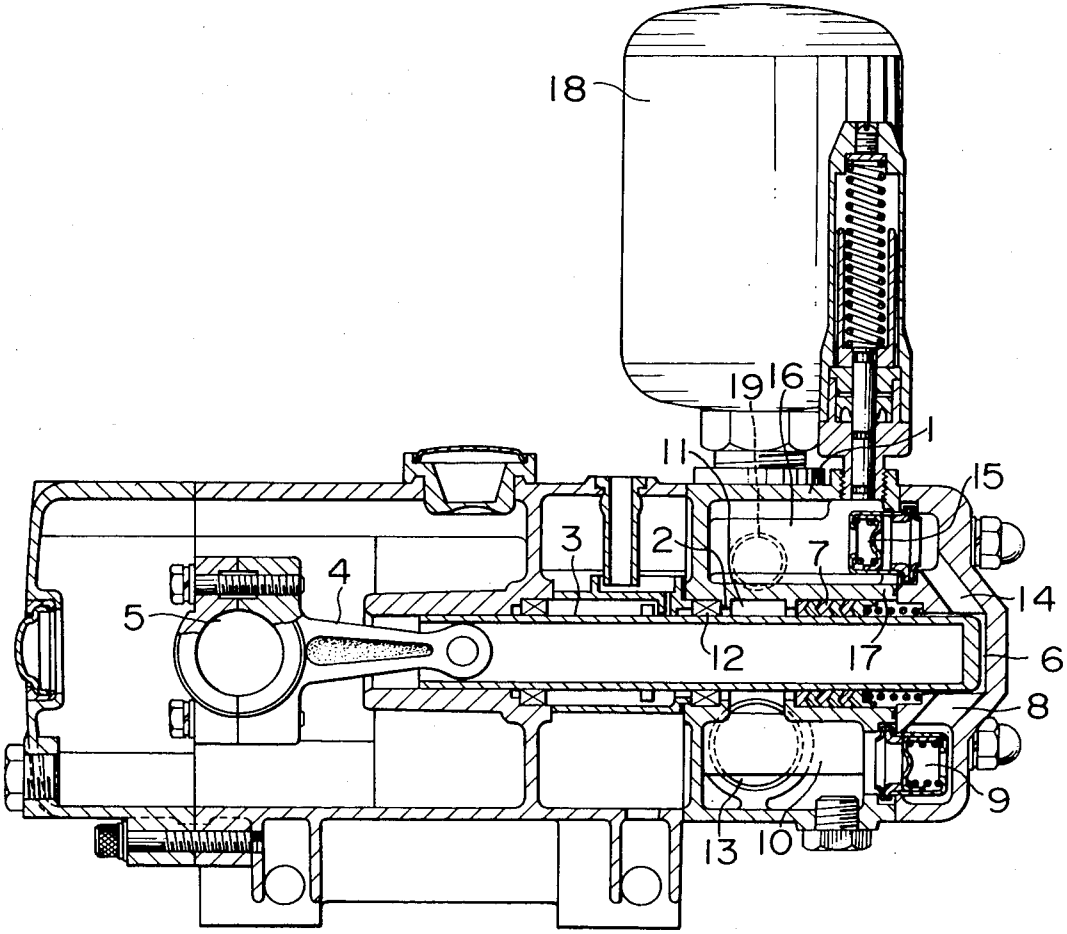
1
2
3
4
5
6
7
8
9
10
11
12
13
14
15
16
17
18
19

PLUNGER PUMP

This application is a continuation of patent co-pending application Ser. No. 30,259, filed Nov. 24, 1987. Itself copending with and a continuation of earlier application Ser. No. 710,076 filed Nov. 11, 1985 both are now abandoned.

BACKGROUND OF THE INVENTION

This invention relates to a plunger pump

Generally, in a plunger pump having a cylinder and a plunger slidably fitted therein, seal packings, such as V-packings, are mounted at an inner peripheral wall surface of the cylinder to prevent leaks of a fluid delivered by the plunger pump under pressure from a pump chamber located at the head of the cylinder through a clearance between the inner peripheral wall surface of the cylinder and an outer peripheral surface of the plunger. In this type of plunger pump, the problem that the V-packings would undergo deterioration due to heat generated by frictional engagement with the plunger which moves in sliding movement in the cylinder during operation has been raised. To obviate this problem, it has hitherto been usual practice to apply a lubricant, such as grease, to the V-packings. However, this solution has not been satisfactory, because it needs the use of a grease cup or other lubricant supply means and makes the construction of the pump complex. In addition, when some type of lubricant supply means is provided, it becomes necessary to check on the presence or absence of the lubricant in the supply means, and trouble occurs when the lubricant is mixed with the fluid which is delivered under pressure by the pump.

SUMMARY OF THE INVENTION

This invention has been developed for the purpose of obviating the aforesaid problem of the prior art. Accordingly, the invention has as its object the provision of a plunger pump, compact in size and simple in construction, which is capable of achieving cooling effects satisfactorily.

According to the invention, there is provided a plunger pump comprising a cylinder formed in a main body of the pump, a plunger fitted in the cylinder for reciprocatory movement axially of the cylinder, a pump chamber defined between a head of the cylinder and a top end portion of the plunger, and seal packings mounted at an inner peripheral wall of the cylinder and maintained in sliding frictional engagement with an outer peripheral surface of the plunger, wherein the improvement comprises an inlet chamber for forwarding a fluid drawn by suction to the pump chamber via a suction valve, and an outlet chamber for receiving a pressurized fluid from the pump chamber via a discharge valve, the inlet chamber and outlet chamber being formed in the main body of the pump and located radially outwardly of the seal packings in close proximity thereto.

By virtue of the constituent features of the invention described hereinabove, the seal packings and plunger are effectively cooled by the fluid in the inlet chamber and outlet chamber, thereby eliminating the need to supply a lubricant to the seal packings to cool same. Besides, the arrangement wherein the inlet chamber and outlet chamber are located around the cylinder as compared with the arrangement of the prior art wherein a suction port and a discharge port are located outwardly of a top end portion of the plunger offers the advantage that the length of the pump can be greatly reduced because it is possible to make good use of a space which has not been utilized in the prior art pump. This makes it possible to obtain an overall compact size in a plunger pump. Since the cooling effects achieved are satisfactory, the service life of the seal packings can be prolonged. Since no lubricant is used, contamination of the handled fluid with a lubricant can be avoided.

BRIEF DESCRIPTION OF THE DRAWING

The single drawing is a vertical sectional view of the plunger pump comprising one embodiment of the invention.

PREFERRED EMBODIMENT OF THE INVENTION

A preferred embodiment of the invention will now be described by referring to the accompanying single drawing.

The plunger pump comprises a main body 1 having a cylinder 2 formed integrally therein which is located horizontally. A plunger 3 is fitted in the cylinder 2 for reciprocatory movement axially thereof and connected, at a bottom end thereof or a left end as viewed in the drawing, to a crankshaft 5 through a connecting rod 4. Thus, rotation of the crankshaft 5 causes the plunger 3 to move in reciprocatory movement in the cylinder 2.

A pump chamber 6 is defined between a head of the cylinder 2 or a right end thereof as viewed in the drawing and a top end of the plunger 3 or a right end thereof as viewed in the drawing. Mounted at an inner peripheral wall of the cylinder 2 are a plurality of V-packings 7 serving as seal packings which are maintained in close sliding frictional engagement with an outer peripheral surface of the plunger 3 which moves in reciprocatory movement during operation, to thereby prevent leaks of a pressurized fluid in the pump chamber 6 to outside via an annular gap between the cylinder 2 and plunger 3.

The pump chamber 6 is maintained in communication via a passageway 8 and a suction valve 9 in the main body 1 with an inlet chamber 10 which is formed in the main body 1 and located downwardly of the cylinder 2 in close proximity thereto. The inlet chamber 10 which is shaped in a manner to extend along the axis of the cylinder 2 is located, at a side thereof facing the pump chamber 6, radially outwardly of the V-packings 7 in close proximity thereto. The inlet chamber 10 is also maintained in communication with an annular chamber 11 which opens to the inner peripheral wall of the cylinder 2 on a left side of the V-packings 7 as viewed in the drawing, so that the plunger 3 can be directly cooled by a fluid drawn by suction. A seal packing 12 mounted to the inner peripheral wall of the cylinder 2 in a position leftwardly of the annular chamber 11 as viewed in the drawing performs the function of keeping the fluid from leaking from the annular chamber 11 to outside via a gap between the cylinder 2 and plunger 3. The inlet chamber 10 draws through an inlet port 13 a fluid which is to be pressurized and delivered under pressure.

The pump chamber 6 is maintained in communication via a passageway 14 and a discharge valve 15 in the main body 1 with an outlet chamber 16 which is formed in the main body 1 and located upwardly of the cylinder 2 in close proximity thereto. The outlet chamber 16 which is shaped in a manner to extend along the axis of the cylinder 2 as is the case with the inlet chamber 10 is contoured to surround an upper half portion of the cylinder 2. At a side facing the pump chamber 6, the outlet chamber 16 is located radially outwardly of the V-packings 7 in close proximity thereto. The outlet chamber 16 is separated from the V-packings 7, annular chamber 11 and inlet chamber 10 by a semi-cylindrical wall 17 of the cylinder 2. An air chamber 18 is located outside the main body 1 in a position above the outlet chamber 16, and the outlet chamber 16 is formed with an outlet port 19 through which a pressurized fluid in the outlet chamber 16 is discharged to outside under pressure.

By virtue of the constituent features of the invention described hereinabove, the plunger 3 and V-packings 7 can be cooled effectively by a fluid drawn by suction into the inlet chamber 10 and annular chamber 11 and a pressurized fluid in the outlet chamber 16. The provision of the inlet chamber 10 and outlet chamber 16 in close proximity to a portion of the cylinder 2 in which the plunger 3 moves in sliding movement offers the advantage that the length of the pump can be greatly reduced as compared with the length of pumps of the prior art, thereby enabling an overall compact size to be obtained in a plunger pump.

What is claimed is:

1. A plunger pump for pumping a fluid comprising:

a main body of the pump;

a cylinder formed in said main body;

a plunger fitted in said cylinder for reciprocatory movement axially of said cylinder;

a pump chamber defined between a head of said cylinder and a top end portion of said plunger;

seal packings mounted at an inner peripheral wall of said cylinder and maintained in sliding frictional engagement with an outer peripherial surface of said plunger;

an inlet chamber for forwarding the fluid drawn by suction to said pump chamber;

a suction valve fitted to said main body and disposed between said pump chamber and said inlet chamber in communication with each other through said suction valve;

an outlet chamber for receiving the pressurized fluid from said pump chamber;

a discharge valve fitted to said main body and disposed between said pump chamber and said outlet chamber in communication with each other through said discharge valve;

said inlet chamber and said outlet chamber formed in said main body of the pump and located radially outwardly of said seal packings in close proximity thereto and extending along the axis of said cylinder, and each contoured to substantially surround a portion of said cylinder and said packings on both sides of said plunger;

said inlet chamber including an annular chamber extending around said cylinder and directly open to said inlet chamber and to said outer peripheral surface of said plunger between said seal packings, and said annular chamber having a suitable width along said plunger allowing the cooling of said plunger and said packings with the fluid in said annular chamber and said inlet chamber drawin by said suction valve into said pump chamber;

all said forementioned chambers located in said main body of the pump;

a semi-cylindrical wall between and separating said outlet chamber from said seal packings, said annular chamber, and said inlet chamber, allowing cooling from all said aforementioned chambers on both radial sides of said semi-cylindrical wall;

a path for the fluid entering the plunger pump extending into said inlet chamber including said annular chamber, then through said suction valve and into said pump chamber and out of said pump chamber through said discharge valve and then said outlet chamber.

* * * * *